US007354138B2

(12) United States Patent
Yokouchi

(10) Patent No.: US 7,354,138 B2
(45) Date of Patent: Apr. 8, 2008

(54) LIQUID DROPLET DISCHARGE HEAD, MANUFACTURING METHOD THEREOF, AND IMAGE FORMING APPARATUS

(75) Inventor: Tsutomu Yokouchi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 378 days.

(21) Appl. No.: 11/180,727

(22) Filed: Jul. 14, 2005

(65) Prior Publication Data

US 2006/0012633 A1 Jan. 19, 2006

(30) Foreign Application Priority Data

Jul. 16, 2004 (JP) ..... 2004-210260

(51) Int. Cl.
*B41J 2/05* (2006.01)

(52) U.S. Cl. ..... 347/56; 347/65

(58) Field of Classification Search ..... 347/20, 347/56, 61, 63, 65, 67, 68, 70, 71–72, 84–87
See application file for complete search history.

(56) References Cited

U.S. PATENT DOCUMENTS 6,488,366 B1 * 12/2002 Potochnik et al. ..... 347/65
2002/0036678 A1 3/2002 Ito et al. ..... 347/71

FOREIGN PATENT DOCUMENTS

JP 5-96726 A 4/1993
JP 6-71880 A 3/1994
JP 7-195693 A 8/1995
JP 2001-47620 A 2/2001
JP 2002-240272 A 8/2002

* cited by examiner

*Primary Examiner*—Juanita D. Stephens
(74) *Attorney, Agent, or Firm*—Birch, Stewart, Kolasch & Birch, LLP

(57) ABSTRACT

The liquid droplet discharge head comprises: a channel which is formed by joining together a plurality of thin plates which are laminated with an adhesive; and an adhesive escape groove which is provided on at least one joined surface of the thin plates in at least one location on a periphery of the channel when a ratio $$\frac{M}{S'}$$

determined in relation to the channel is greater than a predetermined value, wherein: the ratio $$\frac{M}{S'}$$

is a ratio between an area M and an area S'; the area M is an area of the adhesive running off to the channel at joining assuming that no adhesive escape groove is provided on the periphery of the channel, the area M being a projected area on a cross-section perpendicular to a flow direction of the channel; and the area S' is an area of a cross-section perpendicular to the flow direction of the channel at post-joining assuming that no adhesive runs off to the channel.

7 Claims, 12 Drawing Sheets

LIQUID DROPLET DISCHARGE HEAD, MANUFACTURING METHOD THEREOF, AND IMAGE FORMING APPARATUS

BACKGROUND OF THE INVENTION

1. Field of the Invention

The present invention relates to a liquid droplet discharge head, a manufacturing method thereof, and an image forming apparatus, and more specifically to a liquid droplet discharge head, a manufacturing method thereof, and an image forming apparatus that can prevent an adhesive from blocking a liquid channel by being run off when forming the liquid droplet discharge head by laminating a plurality of plates.

2. Description of the Related Art

An inkjet type image forming apparatus (an inkjet recording apparatus) performs recording by discharging ink in droplet form from a plurality of nozzles (droplet discharge ports) formed in a recording head (a liquid droplet discharge head) onto a recording medium. For such a purpose, ink channels are formed in the interior of the recording head to supply the nozzles with ink from an ink tank in which the ink is stored.

This type of recording head is formed by joining together through lamination a plurality of plate members formed with patterns comprising grooves or holes which form the ink channels and the like. As such a joining method, a method is generally known in which the plate members are joined by coating a joint surface of each plate with an adhesive such as epoxy.

However, according to such the joining method of using an adhesive, the adhesive may run off to the opening side when joining. Therefore, ink discharge cannot be performed appropriately, by narrowing or blocking opening portions such as the ink channels and nozzles.

Conventionally, various methods have been proposed to prevent the adhesive from running off when joining a plurality of plate members to ensure stable ink discharge, such as a method of forming an adhesive escape groove in the plates which form the channels, for example.

For example, Japanese Patent Application Publication No. 5-96726 discloses that an adhesive sump is formed on the outside of the channel hole on the surface of the head substrate having the channel and channel hole that is to be adhered to the plate having the ink discharge hole, when forming an inkjet recording apparatus by adhering a head substrate which has a channel and a channel hole to a plate having an ink discharge hole. Therefore, it is possible to prevent the adhesive from blocking the channel, and then defective adhesion due to fins on the channel plate can be also prevented.

In addition, Japanese Patent Application Publication No. 6-71880 discloses that a non-joined portion (false groove) is provided in at least one of the channel substrate and cover plate to make the joint width around the ink channel substantially constant, when forming a head by joining a cover plate to a channel surface side of a channel substrate which is formed with an ink channel, for example. Therefore, it is possible to reduce the amount of adhesive that runs off or to keep the amount of adhesive that runs off at constant, during the joining process.

Furthermore, for example, Japanese Patent Application Publication No. 7-195693 discloses that an inkjet recording head comprising a barrier formed from a photosensitive resin material, which is used to form a plurality of ink discharge ports and liquid channels on a substrate, and a ceiling plate that is joined to the upper surface of the barrier by an adhesive. The inkjet recording head is provides with grooves capable of accommodating the adhesive that runs off between the upper surface of the barrier and the ceiling plate, and then the grooves are formed at the two edge parts contacting the ink discharge ports and liquid channels on the upper surface of the barrier. Therefore, it is possible to prevent the adhesive from running off around the ink discharge ports.

Moreover, for example, Japanese Patent Application Publication No. 2001-47620 discloses that an inkjet head in which one member comprising an opening portion is joined to another member using an adhesive. In the inkjet head, the joint surface of the first member is formed with a plurality of non-penetrating recesses running along at least an edge portion of the opening portion, and the width of a partition wall between the opening portion and non-penetrating recesses of the first member is set to satisfy a predetermined condition. Therefore, it is possible to prevent the adhesive from running off.

However, in Japanese Patent Application Publication No. 5-96726, when providing adhesive sumps around all of the channels in the adhesion surface of the nozzle plate, it is impossible to form the channels at a high density. Additionally, in Japanese Patent Application Publication No. 6-71880, when the joint width is large, it is necessary for providing a large false groove. Therefore, in addition to consume various times for improving the groove, there is a problem of a decrease in the adhesion strength. Additionally, as described above, when providing false grooves for each channel, it is impossible to form the channels at a high density.

In addition, Japanese Patent Application Publication No. 7-195693 is limited to the photosensitive material. Furthermore, in Japanese Patent Application Publication No. 2001-47620, when providing the non-penetrating recesses around each opening portion for preventing the adhesive from running off, it is impossible to form the channels at a high density.

As described above, when forming adhesive escape grooves and the like around all of the channels for preventing the adhesive from run off, extra labor are required in the formation process. In addition, since the channels cannot be formed each other in close proximity, it is impossible to achieve high density.

SUMMARY OF THE INVENTION

The present invention has been designed in consideration of these circumstances, and it is an object thereof to provide a liquid droplet discharge head, a manufacturing method thereof, and an image forming apparatus that can form channels at a high density in the liquid droplet discharge head which is formed by joining a plurality of plates through lamination, while reducing the amount of adhesive that runs off when joining the plates.

In order to attain the aforementioned object, the present invention is directed to a liquid droplet discharge head comprising: a channel which is formed by joining together a plurality of thin plates which are laminated with an adhesive; and an adhesive escape groove which is provided on at least one joined surface of the thin plates in at least one location on a periphery of the channel when a ratio $$\frac{M}{S'}$$

determined in relation to the channel is greater than a predetermined value, wherein: the ratio $$\frac{M}{S'}$$

is a ratio between an area M and an area S'; the area M is an area of the adhesive running off to the channel at joining assuming that no adhesive escape groove is provided on the periphery of the channel, the area M being a projected area on a cross-section perpendicular to a flow direction of the channel; and the area S' is an area of a cross-section perpendicular to the flow direction of the channel at post-joining assuming that no adhesive runs off to the channel.

According to the present invention, the ratio $$\frac{M}{S'}$$

determines whether or not to dispose an adhesive escape groove according to the channel. Therefore, it is possible to reduce the amount of adhesive that runs off to the channels, and to form the channels at a high density. Additionally, it is also possible to optimize manufacturing costs, and to achieve an improvement in refill.

The present invention is also directed to the liquid droplet discharge head wherein: when a shortest distance from the channel to the adhesive escape groove is set as L', a pre-joining thickness of the adhesive applied between the thin plates to be joined is set as t, and a post-joining thickness of the adhesive is set as t', a total area $$M' = \sum (t - t') \times \frac{L'}{2}$$

of the adhesive running off to the channel is obtained by adding together an area $$(t - t') \times \frac{L'}{2}$$

of the adhesive running off for all parts of the channel into which the adhesive runs off; each of the total area M' and the area $$(t - t') \times \frac{L'}{2}$$

is an area which is projected on the cross-section perpendicular to the flow direction of the channel; a ratio $$\frac{M'}{S'}$$

between the total area M' and the area S' of the cross-section perpendicular to the flow direction of the channel is calculated; and the adhesive escape groove is disposed in a position corresponding to the distance L' at which the calculated ratio $$\frac{M'}{S'}$$

is no greater than the predetermined value.

The present invention is also directed to the liquid droplet discharge head wherein the predetermined value is 0.07.

According to the present invention, it is possible to optimize the disposal position of the adhesive escape groove.

In order to attain the aforementioned object, the present invention is directed to a manufacturing method of a liquid droplet discharge head which is formed with a channel by joining together a plurality of thin plates which are laminated with an adhesive, the method comprising the steps of: determining a ratio $$\frac{M}{S'}$$

between an area M and an area S', where the area M is an area of the adhesive running off to the channel at joining assuming that no adhesive escape groove is provided on the periphery of the channel, the area M being a projected area on a cross-section perpendicular to a flow direction of the channel, and the area S' is an area of a cross-section perpendicular to the flow direction of the channel at post-joining assuming that no adhesive runs off to the channel; providing an adhesive escape groove on at least one joined surface of the thin plates in at least one location on a periphery of the channel when the ratio $$\frac{M}{S'}$$

is greater than a predetermined value; and joining together the thin plates including the adhesive escape groove with the adhesive.

In order to attain the aforementioned object, the present invention is directed to an image forming apparatus, comprising the liquid droplet discharge head as described above.

According to the present invention, it is possible to obtain a high quality liquid droplet discharge head in which the channels are not blocked by the adhesive that runs off to the channels, and an image forming apparatus using this liquid droplet discharge head.

As described above, according to the liquid droplet discharge head, manufacturing method thereof, and image forming apparatus of the present invention, it is possible to select the locations in which dispose adhesive escape grooves when forming the channels by joining together plate members, and then to provide the adhesive escape grooves only where they are genuinely required. Therefore, it is possible to reduce the amount of adhesive running off to the channels while maintaining a high density of channels.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 8A is a plan view thereof, and FIG. 8B is a sectional view thereof along a line 8B-8B in FIG. 8A;

FIG. 9A is a plan view thereof, and FIG. 9B is a sectional view thereof along a line 9B-9B line in FIG. 9A;

FIG. 10A shows a state prior to hardening of the adhesive, and FIG. 10B shows a state after hardening of the adhesive;

DETAILED DESCRIPTION OF THE PREFERRED EMBODIMENTS

Figure 1:
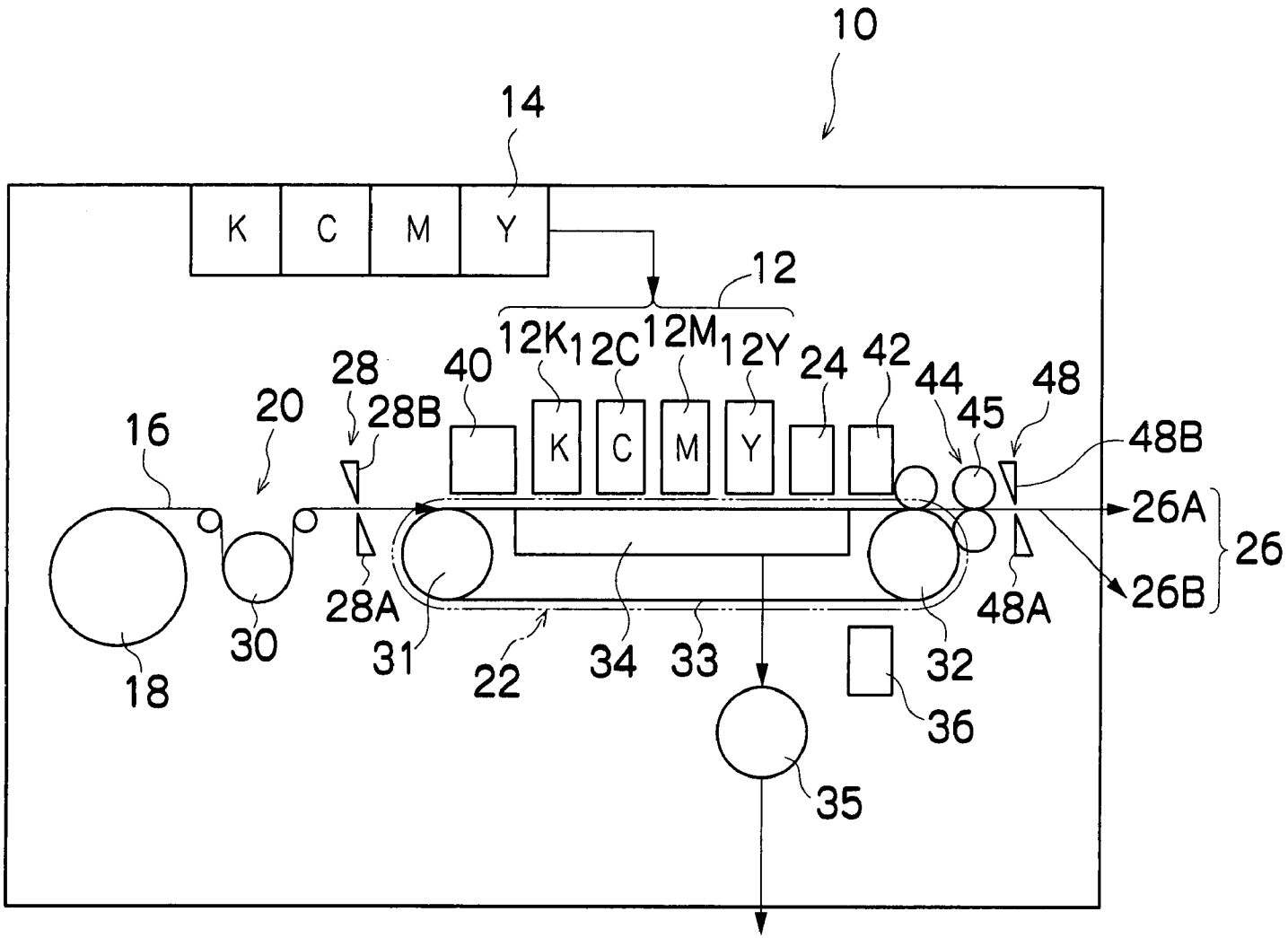
FIG. 1 is a general schematic drawing of an inkjet recording apparatus as an image forming apparatus according to an embodiment of the present invention.

FIG. 1 is a general schematic drawing showing an inkjet recording apparatus as an image forming apparatus according to an embodiment of the present invention.

As shown in FIG. 1, an inkjet recording apparatus 10 comprises: a printing unit 12 having a plurality of print heads 12K, 12C, 12M, and 12Y provided for each ink color; an ink storing and loading unit 14 in which the ink supplied to the print heads 12K, 12C, 12M, and 12Y is stored; a paper supply unit 18 which supplies recording paper 16; a decurling unit 20 which removes curls from the recording paper 16; a suction belt conveyance unit 22 disposed opposite a nozzle face (ink discharge face) of the printing unit 12 for conveying the recording paper 16 while maintaining the flatness of the recording paper 16; a print determination unit 24 which reads printing results generated by the printing unit 12; and a paper output unit 26 which outputs the printed recording paper (printed object) to the outside.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of an apparatus constitution using rolled paper, as shown in FIG. 1, a cutter 28 is provided, and the rolled paper is cut into the desired size by this cutter 28. The cutter 28 is composed of a stationary blade 28A having a length which is equal to or greater than the width of the conveyance path for the recording paper 16, and a round blade 28B which moves along the stationary blade 28A. The stationary blade 28A is provided on the rear side of the print surface, and the round blade 28B is disposed on the print surface side so as to sandwich the conveyance path together with the stationary blade 28A. Note that when cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet discharge is controlled so that the ink-droplets are discharged in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 is composed of the print heads 12K, 12C, 12M, and 12Y corresponding to the four colors (KCMY). Each of the print heads 12K, 12C, 12M, and 12Y comprises a plurality of discharge ports (nozzles). The print heads 12K, 12C, 12M, and 12Y are arranged length in the width direction of the recording paper 16 (main scanning direction), which is perpendicular to the paper conveyance direction (sub-scanning direction), so as to cover the entire width of the recording paper 16. Thus, each of the print heads 12K, 12C, 12M, and 12Y forms a so-called full-line head having a length which corresponds to the maximum paper width (see FIG. 2).

Figure 2:
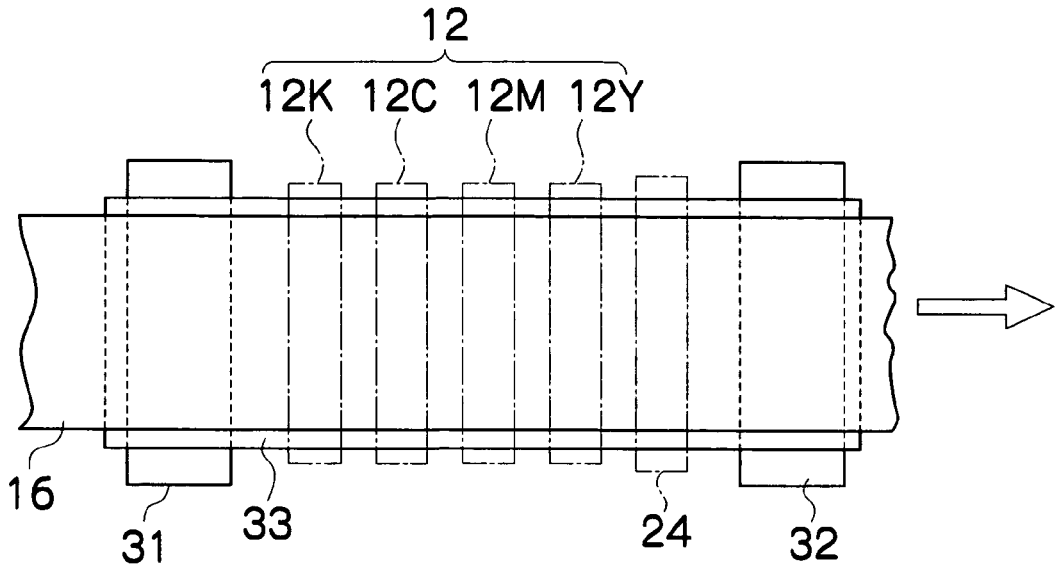
FIG. 2 is a plan view of principal part of the peripheral area of a printing unit in the inkjet recording apparatus shown in FIG. 1.

As shown in FIG. 2, each of the print heads 12K, 12C, 12M, and 12Y is configured as a line head in which the plurality of ink discharge ports (nozzles) are arranged in the lengthwise direction of the print heads 12K, 12C, 12M, and 12Y over a length which exceeds at least one side of the maximum size recording paper 16 used in the inkjet recording apparatus 10.

As described in more detail hereafter, each of print heads 12K, 12C, 12M, and 12Y comprises a detection device for detecting ink discharge, an optical system for forming the luminous flux used in this detection into a predetermined shape, and various devices relating to the detection of the state of ink discharge, the ink droplet size, the ink discharge speed, and so on.

The print heads 12K, 12C, 12M, and 12Y are arranged in this order from the upstream side (the left side in FIG. 2) along the paper conveyance direction. A color print can be formed on the recording paper 16 by discharging the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the paper conveyance direction (sub-scanning direction) just once (in other words, by means of a single sub-scan). Higher-speed printing is thereby made possible and productivity can be improved in comparison with a shuttle type head in which a recording head moves reciprocally in the direction (main scanning direction) perpendicular to the paper conveyance direction (sub-scanning direction).

The terms "main scanning direction" and "sub-scanning direction" are used in the following senses. In a full-line head comprising a row of nozzles that have a length corresponding to the entire width of the recording paper, the "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) driving the nozzles sequentially from one side toward the other side; and (3) dividing the nozzles into blocks and driving the blocks of the nozzles sequentially from one side toward the other side. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the recording paper is the sub-scanning direction and the direction perpendicular to the sub-scanning direction is called the main scanning direction.

Although the configuration with the KCMY four standard colors is described in the present embodiment, combinations of the ink colors and the number of colors are not limited to those. Light and/or dark inks can be added as required. For example, a configuration is possible in which inkjet heads for discharging light-colored inks such as light cyan and light magenta are added. Furthermore, there are no particular restrictions of the sequence in which the print heads of respective colors are arranged.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, 12Y, via a tube channel (not shown). Moreover, the ink storing and loading unit 14 also comprises notifying means (display means, alarm generating means, or the like) for generating a notification if the remaining amount of ink has become low. Furthermore, the ink storing and loading unit 14 also comprises a mechanism for preventing incorrect loading of the wrong colored ink.

The print determination unit 24 has an image sensor (line sensor or the like) for capturing an image of the ink-droplet deposition result of the printing unit 12, and functions as a device to check for discharge defects such as clogs of the nozzles in the printing unit 12 from the ink-droplet deposition results evaluated by the image sensor.

The print determination unit 24 of the present embodiment is configured with at least a line sensor having rows of photoelectric conversion elements with a width that is greater than the ink-droplet discharge width (image recording width) of the print heads 12K, 12C, 12M, and 12Y This line sensor has a color separation line CCD sensor including a red (R) sensor row composed of photoelectric conversion elements (pixels) arranged in a line provided with an R filter, a green (G) sensor row with a G filter, and a blue (B) sensor row with a B filter. Instead of a line sensor, it is possible to use an area sensor composed of photoelectric conversion elements which are arranged two-dimensionally.

The print determination unit 24 reads a test pattern image printed by the print heads 12K, 12C, 12M, and 12Y for the respective colors, and the discharge from each head is determined. The discharge determination includes the presence of the discharge, measurement of the dot size, and measurement of the dot deposition position.

A post-drying unit 42 is disposed following the print determination unit 24. The post-drying unit 42 is a device for drying the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device for controlling the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (a second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawings, the paper output unit 26A for the target prints is provided with a sorter for collecting prints according to print orders.

Figure 3:
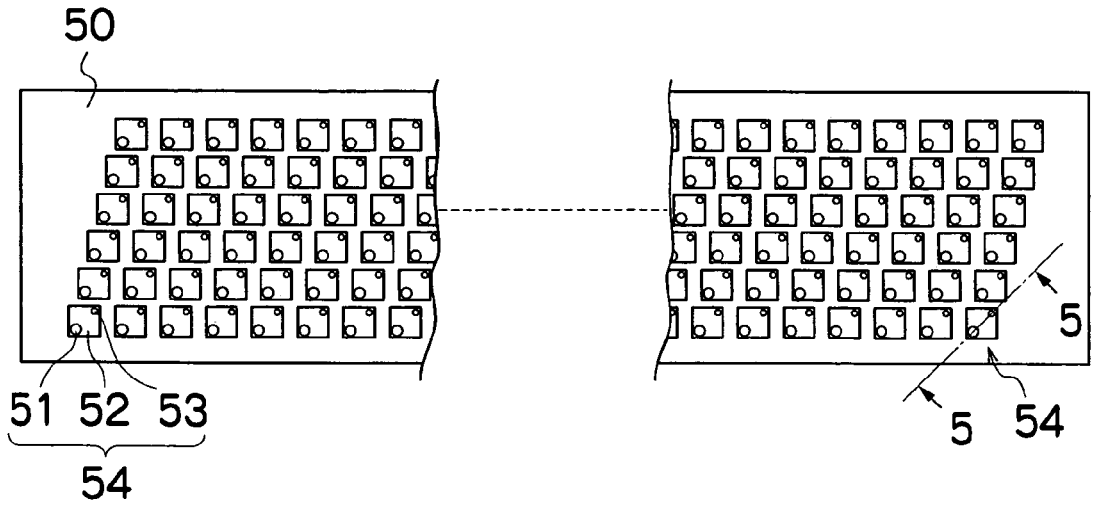
FIG. 3 is a plan view showing the region of a print head in the inkjet recording apparatus shown in FIG. 1.

Next, the structure of a print head (liquid droplet discharge head) will be described. The print heads 12K, 12C, 12M and 12Y provided for the respective ink colors have the same structure, and a reference numeral 50 is hereinafter designated to any of the heads. FIG. 3 shows a plan perspective view of the print head 50.

As shown in FIG. 3, the print head 50 according to the present embodiment achieves a high density arrangement of nozzles 51 by using a two-dimensional staggered matrix array of pressure chamber units 54. Each of the pressure chamber units 54 comprises a nozzle 51 for discharging ink as ink droplets, a pressure chamber 52 for applying pressure to the ink in order to discharge ink, and an ink supply port 53 for supplying ink to the pressure chamber 52 from a common channel (not shown).

Figure 4:
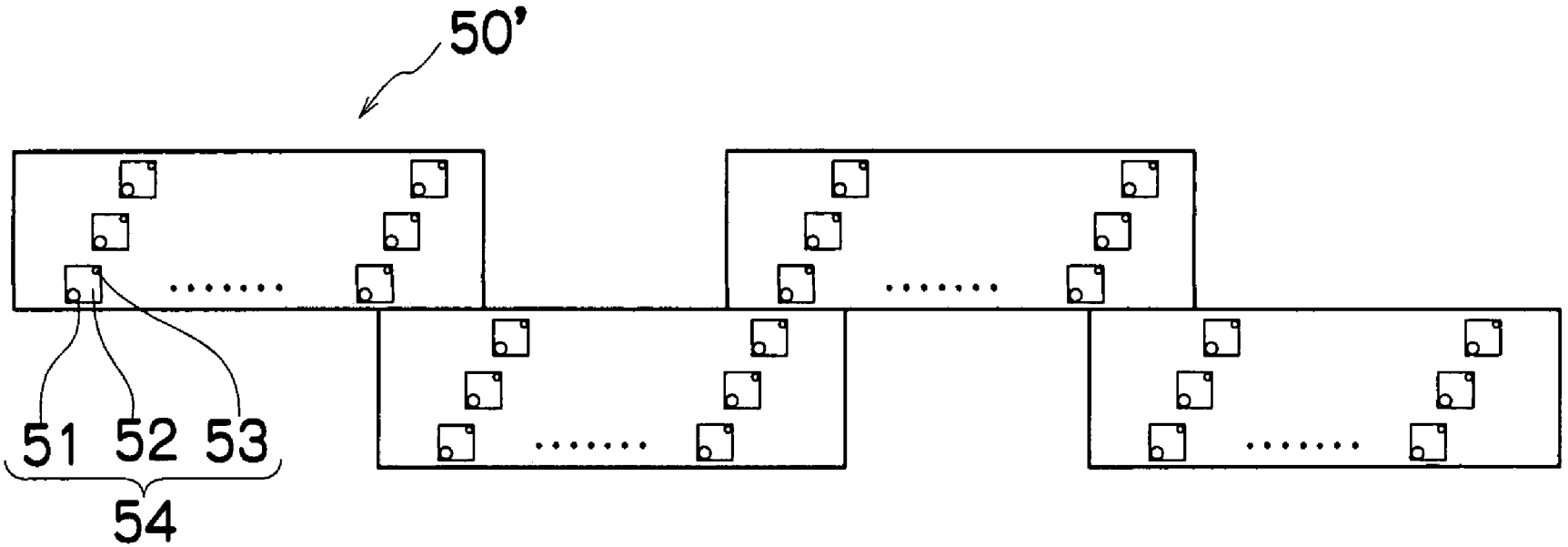
FIG. 4 is a plan view showing a further example of a print head.

According to the embodiment, each of the print heads 12K, 12C, 12M, and 12Y shown in FIG. 2 (the print head 50) is configured as a full-line head shown in FIG. 3 in which the plurality of ink discharge ports (nozzles 51) are arranged over a length which exceeds at least one side of the maximum size of the recording paper 16 which is used in the inkjet recording apparatus 10. However, as shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
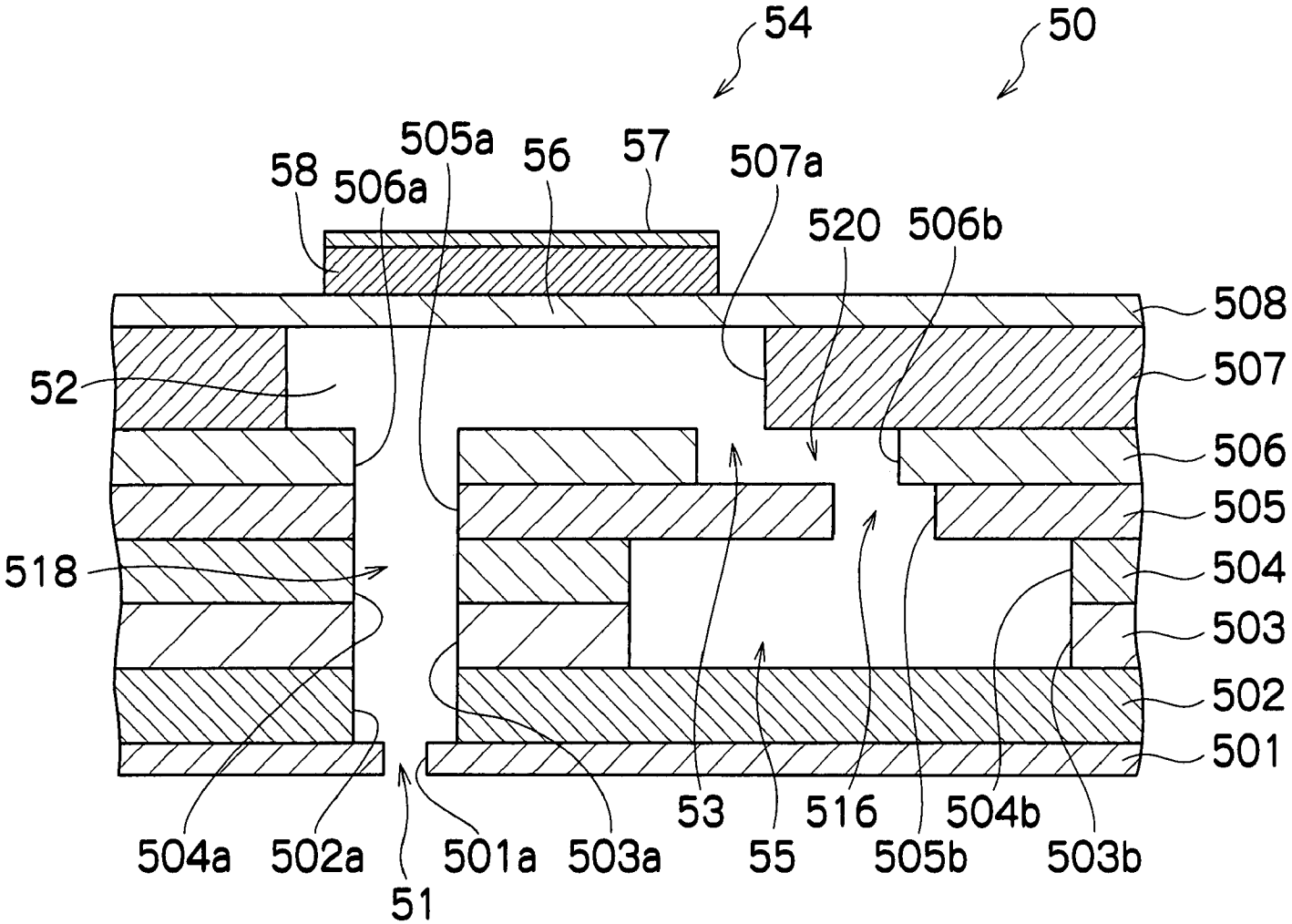
FIG. 5 is a sectional view along a line 5-5 in FIG. 3.

FIG. 5 is a sectional view of a pressure chamber unit 54 in the print head 50 along a line 5-5 shown in FIG. 3.

As shown in FIG. 5, the print head 50 is formed by laminating a nozzle plate 501, a shielding plate 502, a main flow plate 503, a tributary plate 504, a supply plate 505, a throttle plate 506, a pressure chamber plate 507, and a diaphragm plate 508.

Each of those plate members 501 to 508 is a lamination plate having a thickness of approximately 30 to 200 μm, which is formed by subjecting an SUS plate to wet etching. A fixed pattern is formed on each of plate members 501 to 508.

A large number of nozzle holes 501*a* as an opening portion of the nozzles 51 are pierced through the nozzle plate 501 in staggered form, as shown by the reference numeral 51 in FIG. 3. A nozzle channel hole 502*a* corresponding to the nozzle hole 501*a* in the nozzle plate 501 is provided in the shielding plate 502.

The main flow plate 503 is provided with a nozzle channel hole 503*a* corresponding to the nozzle channel hole 502*a* in the shielding plate 502, and a common channel hole 503*b* which forms a common channel 55.

The tributary plate 504 is provided with a nozzle channel hole 504*a* corresponding to the nozzle channel hole 503*a* in the main flow plate 503, and a common channel hole 504*b* corresponding to the common channel hole 503*b* in the main flow plate 503.

The supply plate 505 is provided with a nozzle channel hole 505*a* corresponding to the nozzle channel hole 504*a* in the tributary plate 504, and an individual channel hole 505*b* forming an individual channel 516.

The throttle plate 506 is provided with a nozzle channel hole 506*a* corresponding to the nozzle channel hole 505*a* in the supply plate 505, and a supply throttling hole 506*b* which forms a supply throttling portion 520 and the ink supply port 53 to the pressure chamber 52.

The pressure chamber plate 507 is provided with a pressure chamber hole 507*a* which forms the pressure chamber 52. The pressure chamber hole 507*a* corresponds to the nozzle channel hole 506*a* and a part of the supply throttling hole 506*b* in the throttle plate 506. In particular, a part that the pressure chamber hole 507*a* and the supply throttling hole 506*b* overlap forms the ink supply port 53.

The diaphragm plate 508 is laminated onto the pressure chamber plate 507 to form the ceiling of the pressure chamber 52. The part of the diaphragm plate 508 forming the ceiling of the pressure chamber 52 has a function as a diaphragm 56 which deforms to vary the volume of the pressure chamber 52.

An actuator (piezoelectric element) 58 is provided on the diaphragm 56, and an individual electrode 57 is provided on the upper surface of the actuator 58. The diaphragm 56 also serves as a common electrode, and the actuator 58 provided for each of pressure chambers 52 is driven by applying a voltage to the common electrode (the diaphragm 56) and individual electrode 57.

The plate members 501 to 508 are laminated as described above, so as to form the pressure chamber 52, the common channel 55, an individual channel 516, the supply throttling portion 520, the ink supply port 53, and a nozzle channel 518.

The nozzle 51 (nozzle hole 501*a*) communicates with the pressure chamber 52 via the nozzle channel 518. The pressure chamber 52 communicates with the common channel 55 via the ink supply port 53, the supply throttling portion 520, and the individual channel 516. The common channel 55 also communicates with an ink tank (not shown), which serves as an ink supply source.

In the pressure chamber unit 54 constituted in this manner, when a drive voltage is applied to the common electrode (diaphragm 56) and the individual electrode 57, the actuator 58 is deformed, the volume of the pressure chamber 52 is thereby changed, and the pressure in the pressure chamber 52 is thereby changed, so that the ink inside the pressure chamber 52 is thus discharged through the nozzle 51.

Next, the configuration of an ink supply system in the inkjet recording apparatus 10 of the embodiment will be described.

Figure 6:
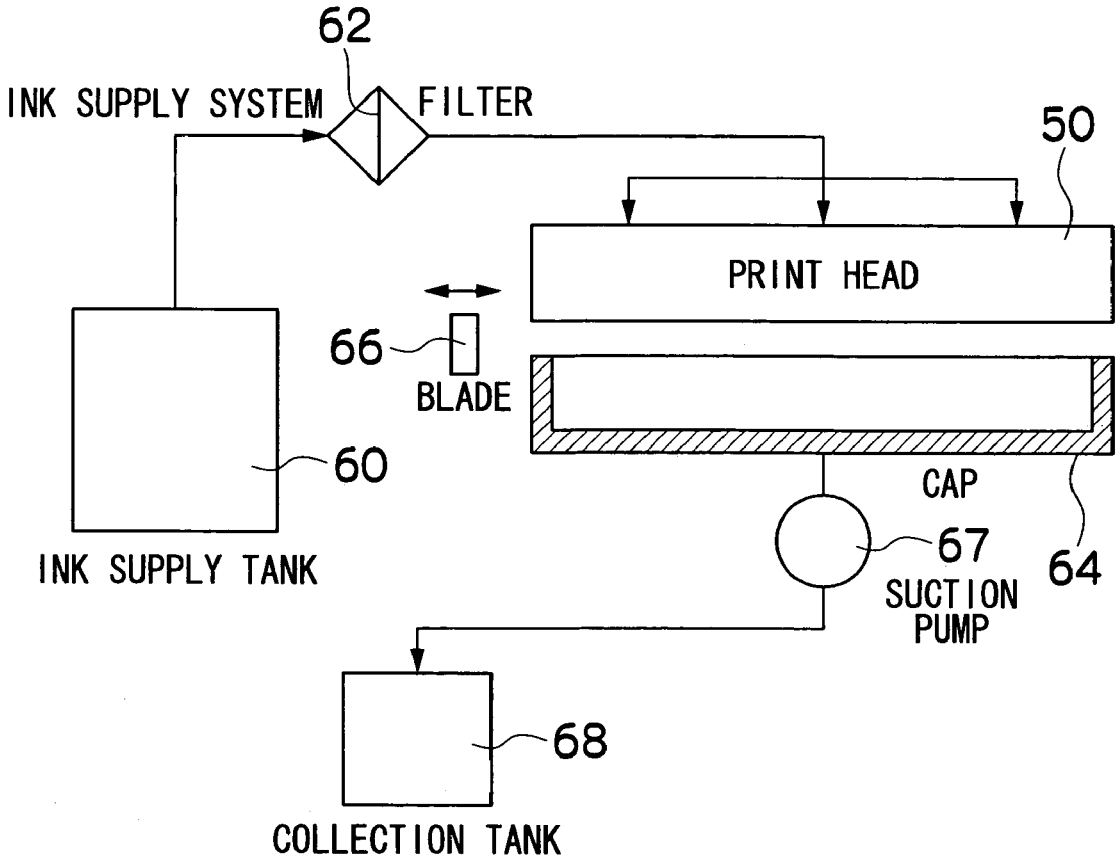
FIG. 6 is a schematic drawing showing the configuration of the ink supply system in the inkjet recording apparatus according to the embodiment.

FIG. 6 is a schematic drawing showing the configuration of the ink supply system in the inkjet recording apparatus 10 according to the embodiment. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform discharge control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the print head 50 as shown in FIG. 6. The filter mesh size in the filter 62 is preferably equivalent to or less than the diameter of the nozzle of the print head 50 and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle region of the nozzle face 50A is thereby covered with the cap 64.

The cleaning blade 66 is composed of rubber or another elastic member, and can slide on the ink discharge surface (nozzle face 50A) of the print head 50 by means of a blade movement mechanism (not shown). When ink droplets or foreign matter has adhered to the nozzle face 50A, the nozzle face 50A is wiped and cleaned by sliding the cleaning blade 66 on the nozzle face 50A.

During printing or standby, when the frequency of use of specific nozzles 51 is reduced and ink viscosity increases in the vicinity of the nozzles, a preliminary discharge is made to discharge the degraded ink toward the cap 64.

Also, when bubbles have become intermixed in the ink inside the print head 50 (inside the pressure chamber 52), the cap 64 is placed on the print head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 58 for the discharge driving is operated. Before reaching such a state (in a viscosity range that allows discharge by the operation of the actuator 58), the actuator 58 is operated to perform the preliminary discharge to discharge the ink whose viscosity has increased in the vicinity of the nozzle toward the ink receptor. After the nozzle face 50A is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

When bubbles become mixed into the ink in the nozzle 51 or pressure chamber 52, or when the viscosity of the ink inside the nozzle 51 has increased to or above a certain level, the ink can no longer be discharged from the nozzle 51 by operating the actuator 58. In such cases, the cap 64 is placed on the nozzle face 50A of the print head 50, and a suction operation is performed to remove the ink intermixed with bubbles or viscous ink from the pressure chamber 52 using the pump 67.

However, since this suction action is performed with respect to all the ink in the pressure chambers 52, the amount of ink consumption is considerable. Therefore, a preferred aspect is one in which a preliminary discharge is performed when the increase in the viscosity of the ink is small. The cap 64 shown in FIG. 6 functions as a suction device, and may also function as a preliminary discharge ink receiver.

It is also preferable to divide the inside of the cap 64 into a plurality of areas corresponding to the nozzle arrays using partition walls, so that suction can be performed on each of the partitioned areas selectively using a selector or the like.

Next, a control system in the inkjet recording apparatus 10 according to the embodiment will be described.

Figure 7:
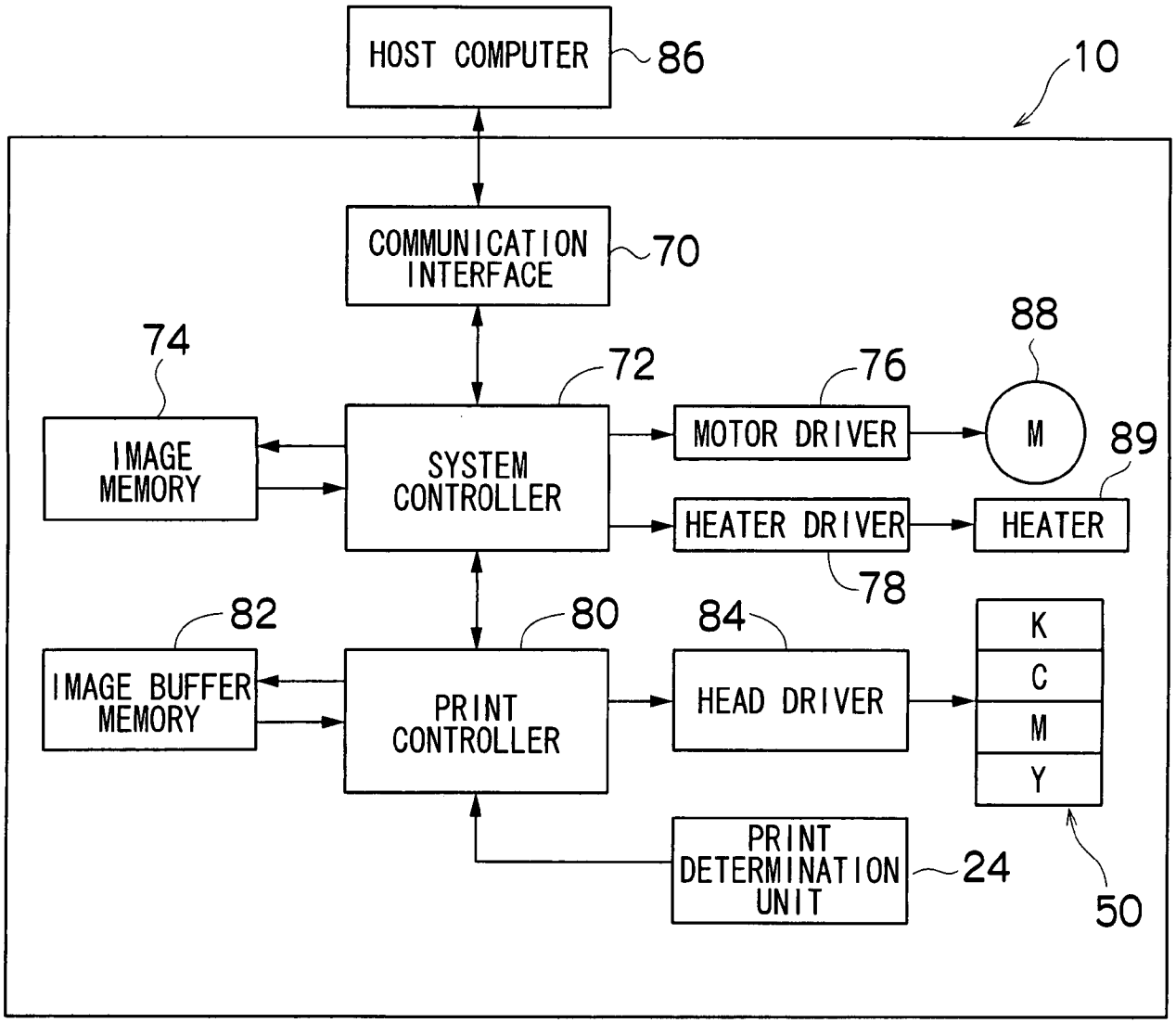
FIG. 7 is a principal block diagram showing the control system configuration of the inkjet recording apparatus according to the embodiment.

FIG. 7 is a principal block diagram showing the control system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit which controls various units such as the communication interface 70, image memory 74, motor driver 76, and heater driver 78. The system controller 72 is constituted by a central processing unit (CPU) and the peripheral circuits and so on thereof, and controls communication with the host computer 86, reading and writing in relation to the image memory 74, and so on. The system controller 72 also generates control signals for controlling a motor 88 of the conveyance system and a heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the discharge amount and the discharge timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 of the print heads 50 of the respective colors according to print data supplied by the print controller 80. The head driver 84 can be provided with a feedback control system for maintaining constant drive conditions for the print heads.

The print determination unit 24 is a block that includes the line sensor (not shown) as described above with reference to FIG. 1, reads the image printed on the recording paper 16, determines the print conditions (presence of the discharge, variation in the dot formation, and the like) by performing desired signal processing, or the like, and provides the determination results of the print conditions to the print controller 80.

According to requirements, the print controller 80 makes various corrections with respect to the print head 50 according to information obtained from the print determination unit 24.

In the present embodiment, in the case of forming the print head 50 comprising the ink channels and so on in its interior by laminating together the plate members as shown in FIG. 5, adhesive escape grooves are provided to prevent the adhesive used to join the plate members from running off and blocking the channels and so on. Additionally, in order to ensure that the high density of the channels is not affected adversely, the adhesive escape grooves are provided only in parts which genuinely require those, so as to decrease the number of adhesive escape grooves provided in the print head 50.

Next, an experiment for determining the parts that require adhesive escape grooves will be described before describing the adhesive escape groove.

In the present experiment, after laminating channel plates which is coated with an adhesive, two types of trial channels having different widths are formed by applying pressure and heat to harden the adhesive. At this time, the degree of adhesive running off is determined according to the flow of liquid through the created channels.

Figure 8A:
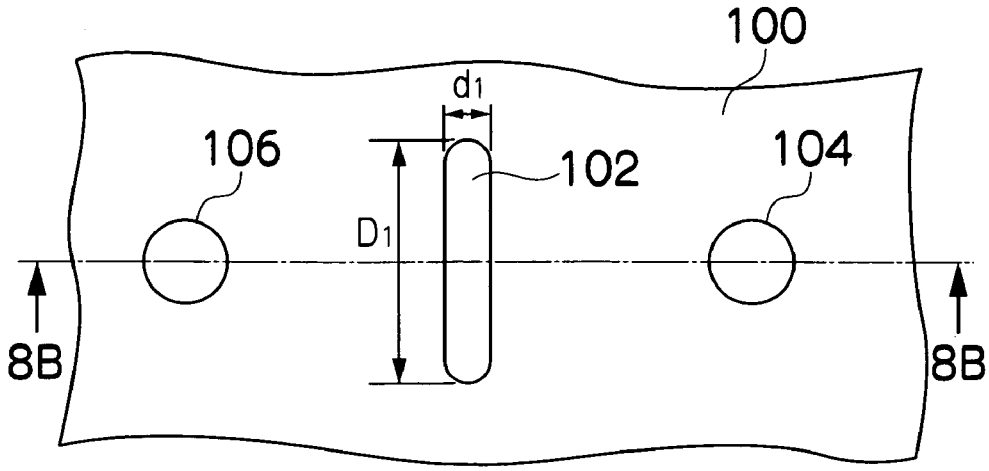
FIGS. 8A and 8B are diagrams showing a trial channel manufactured to determine the amount of adhesive running off to the channel.
Figure 8B:
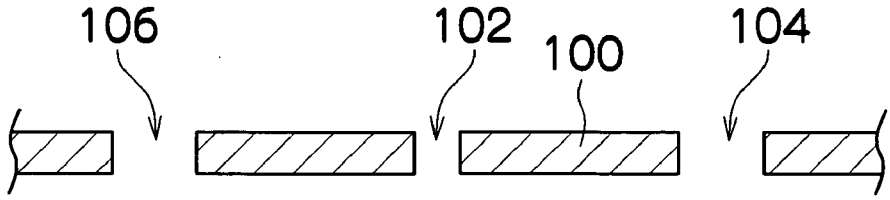
Figure 9A:
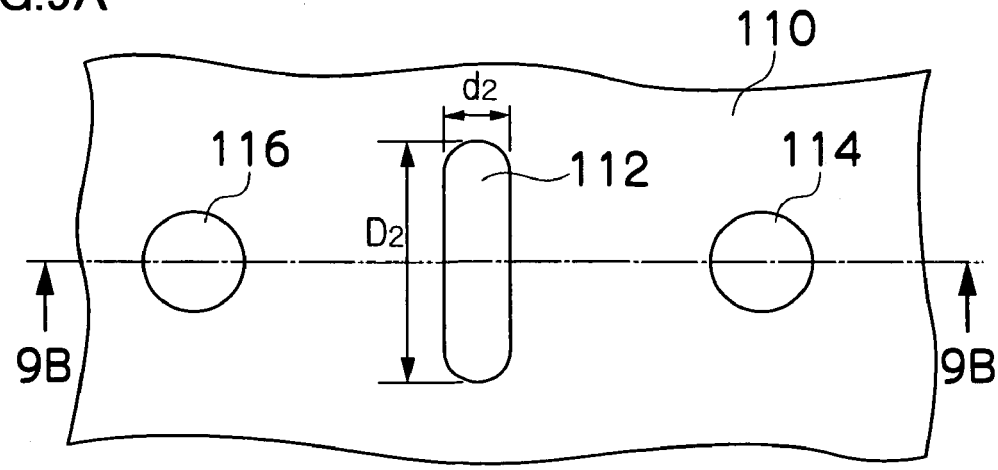
FIGS. 9A and 9B are diagrams showing another trial channel manufactured to determine the amount of adhesive running off to the channel.
Figure 9B:
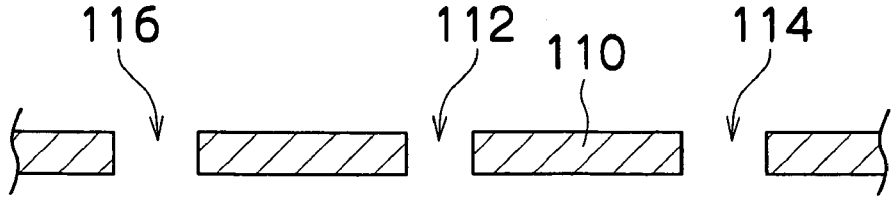

FIGS. 8A, 8B, 9A, and 9B show the two types of channel plate used in the experiment. The channel plates shown the diagrams correspond to a channel plate which is formed with a hole (channel), similarly to the plate members 501 to 507 shown in FIG. 5. The channel plate shown in FIGS. 8A and 8B is a channel plate 100 having a channel 102 with a channel width of approximately 50 μm. FIG. 8A shows a plan view thereof, and FIG. 8B shows a sectional view thereof along a line 8B-8B in FIG. 8A. Furthermore, the reference numerals 104 and 106 indicate structures such as the other holes on which there are no particular limitations, and no adhesive escape groove is provided around the channel 102. On the other hand, the channel plate shown in FIGS. 9A and 9B is a channel plate 110 having a channel 112 with a channel width of approximately 80 μm. FIG. 9A shows a plan view thereof, and FIG. 9B shows a sectional view thereof along a line 9B-9B in FIG. 9A. Furthermore, the reference numerals 114 and 116 indicate other structures on which there are no particular limitations, and no adhesive escape groove is provided around the channel 112.

As shown in FIG. 8A, the channel 102 of the channel plate 100 is set with a width d1 of approximately 50 μm, and a length D1 of approximately 350 μm. As shown in FIG. 9A, the channel 112 of the channel plate 110 is set with a width d2 of approximately 80 μm, and a length D2 of approximately 350 m. The thickness of the channel plates 100 and 110 is approximately 40 μm.

The channels are formed by joining the channel plates 100 and 110 to the other plate members with a 1-liquid type thermosetting epoxy adhesive. The adhesive has a thickness of approximately 5 μm at the time of coating, and a thickness of approximately 4 μm at the time of hardening. It is supposed that this reduction in thickness of approximately 1 μm is due to the effect of pressure application and so on.

At this experiment, when the liquid has flowed actually through the trial channels 102 and 112, it is observed that the liquid is flowed poorly through the channel 102 having a width of approximately 50 μm, but is flowed relative smoothly through the channel 112 having a width of approximately 80 μm. As described above, no adhesive escape grooves have been provided around the channels 102 and 112. Accordingly, it may be necessary for providing an adhesive escape groove around the channel 102 having a channel width of approximately 50 μm.

According to the above, it is possible to consider a following model as a reference for determining the location in which an adhesive escape groove is required.

As the ink channel provided in the print head 50, an example is described in which the ink flow direction mainly corresponds to the lengthwise direction of the channel. Hereinafter, the adhesive running off from the breadthways direction (width direction) of the channel is considered on a cross-section perpendicular to the channel flow direction.

Accordingly, when determining the amount of adhesive that runs off to the channel, the size of the surface area of the run-off adhesive which is projected onto a cross-section perpendicular to the flow direction of the channel is regarded as the amount of adhesive.

Figure 10A:
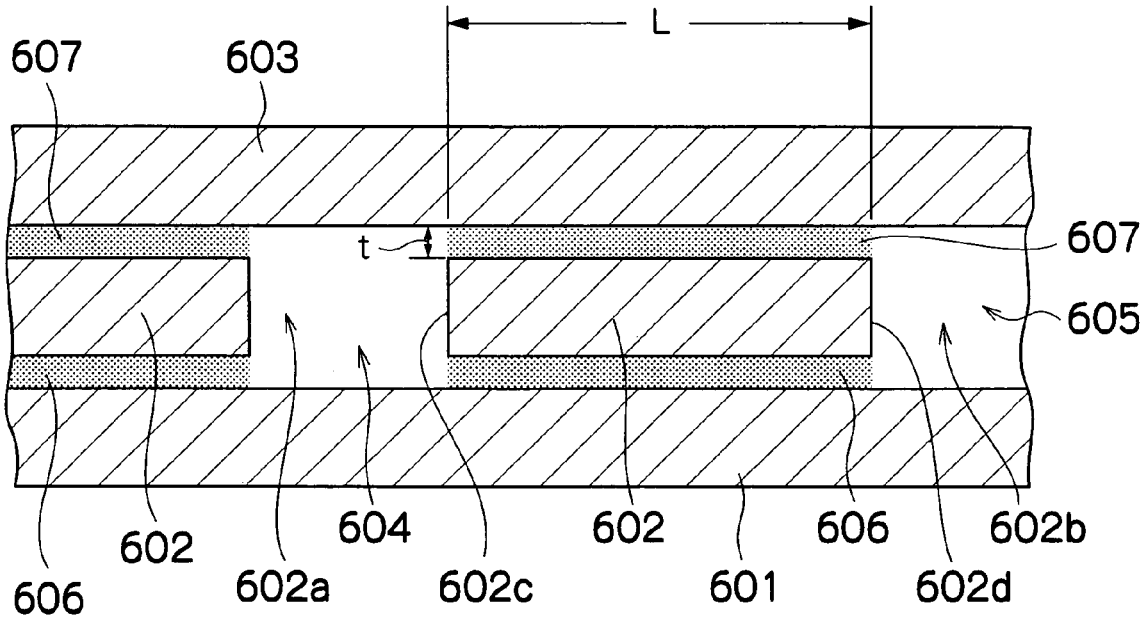
FIGS. 10A and 10B are sectional views showing each channel as a model for determining a condition for selecting a channel disposed an adhesive escape groove.
Figure 10B:
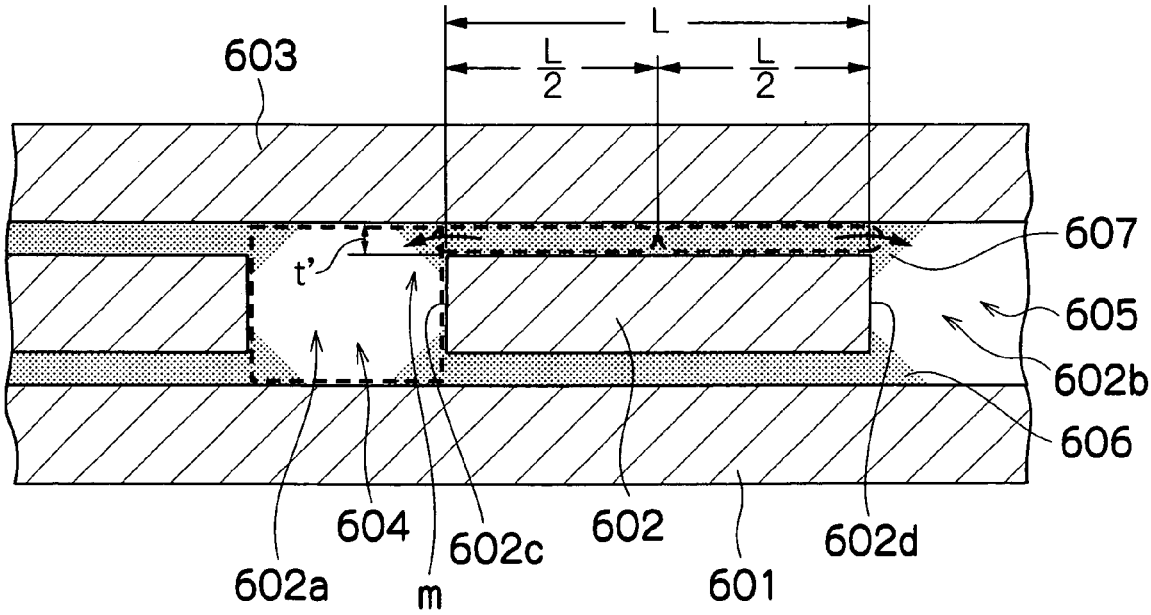

FIGS. 10A and 10B are schematic sectional views of the channels formed by joining the laminated plate members with the adhesive. FIG. 10A shows a state which laminates the plate members coated with the adhesive, and FIG. 10B shows a state in which the adhesive has been hardened by applying pressure and heat to the laminated plate members in FIG. 10A.

As shown in FIG. 10A, a channel 604 and other structure (hole) 605 are formed by joining plate members 601 and 603 with adhesives 606 and 607 to each side of a channel plate 602 having a channel hole 602*a* and other hole 602*b*.

FIG. 10A shows a state in which the adhesives 606 and 607 are applied onto the surfaces of the channel plate 602 to laminate in order of the plate member 601, the channel plates 602, and the plate member 603. When pressure and heat are applied to the laminated plates in this laminated state, the adhesives 606 and 607 run off to opening portions such as the channel 604 and other hole 605 from the joint portions which are formed between the channel plate 602 and plate members 601 and 603, as shown in FIG. 10B.

For example, in the case of the channel 604 shown in FIGS. 10A and 10B, the adhesives 606 and 607 run off from corner portions of the square in the cross-section of the channel 604. However, only the upper right corner portion in the cross-section of the channel 604 will be described herein.

As shown in FIG. 10A, it is assumed that "L" is a distance from a side face 602*c* of the channel hole 602*a* in the channel plate 602 to a side face 602*d* in the other hole 602*b*, and that "t" is a thickness of the adhesive 607 between a part corresponding to L in the channel plate 602 and the plate member 603 on the above-described part before the adhesive 607 hardens by applying pressure and heat.

As shown in FIG. 10B, it is assumed that "t'" is the thickness of the adhesive 607 between the channel plate 602 and plate member 603 when the adhesive is hardened by applying pressure and heat to the laminated plates.

As the reason why the thickness of the adhesive 607 becomes the t' after hardening from the t before hardening, it is considered that the adhesive 607 runs off to opening portions such as the channel 604 in an amount corresponding to the reduction in thickness (t−t'). More specifically, it may be considered that the adhesive 607 between the channel plate 602 and plate member 603 in the part corresponding to the distance L between the side face 602*c* of the channel hole 602*a* and the side face 602*d* of the other hole 602*b* runs off to sides of the channel 604 and the other hole 605 in lengths $$\frac{L}{2},$$

corresponding to substantially half of the length L, as shown in FIG. 10B.

Hence, as shown in FIG. 10B, an amount "m" of the adhesive 607 that runs off to the upper right part on the cross-section of the channel 604 may be considered as $$(t-t')\times\frac{L}{2}.$$

Figure 11:
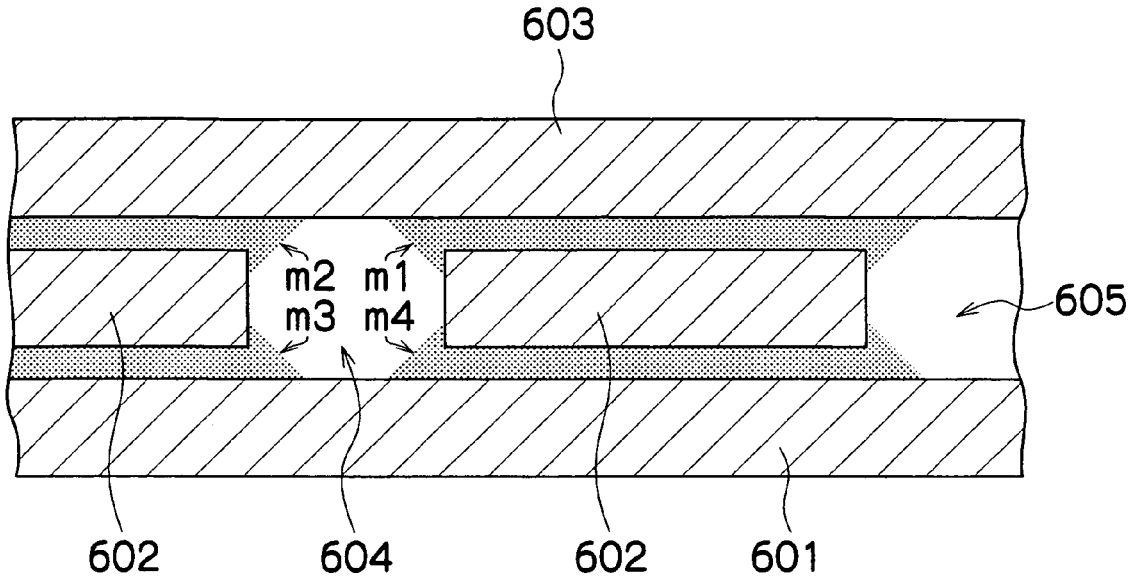
FIG. 11 is a sectional view of an example similar to those of FIGS. 10A and 10B.

The amount m of the adhesive that runs off from one spot of the cross-section of the channel 604 is expressed using this equation. Accordingly, as shown in FIG. 11, a total amount "M" of the adhesives 606 and 607 that runs off to the cross-section of the channel 604 corresponds to a sum total of amounts m1, m2, m3, and m4 running off from each corner portion of the square, and is therefore expressed by the following equation:

$$M = m1 + m2 + m3 + m4 = \sum_n m_n$$

(however, the sum Σ is taken from n=1 to 4).

Herein, the amount "$m_n$" of adhesive running off from each spot is as follows. It is assumed that $t_n$, $t_n'$, and $L_n$ are values corresponding to t, t', and L shown in FIGS. 10A and 10B, respectively. More specifically, $t_n$ is a thickness of the adhesive in the corresponding part before hardening, $t_n'$ is a thickness of the adhesive after hardening, and $L_n$ is a distance from the part of the channel from which the adhesive runs off to the adjacent structure, then the amount $m_n$ of adhesive running off from this single location is expressed by the following equation:

$$m_n = (t_n - t_n')\times\frac{L_n}{2}.$$

Furthermore, when "N" is the number of points in which the adhesive runs off, the total amount M of adhesive which runs off is typically the sum Σ in $M=\Sigma m_n$ taken from n=1 to N. More specifically, the total amount of adhesive which runs off in a typical case is expressed by the following equation (1):

$$\text{Total amount } M = \sum_{n-1}^{N}(t_n - t_n')\times\frac{L_n}{2}. \quad (1)$$

In addition, as shown in the example in FIG. 11 (or FIGS. 10A and 10B), when the adhesive runs off from four points, the total amount "M" of adhesive which runs off is expressed by the following equation (2):

$$\text{Total amount } M = \sum_{n=1}^{4} m_n = \sum_{n=1}^{4} (t_n - t'_n) \times \frac{L_n}{2}. \quad (2)$$

Thus, when there are four run-off locations, and the values t, t', and L of each run-off location are identical, the total run-off amount M is expressed by the following equation:

$$M = (t - t') \times \left(\frac{L}{2}\right) \times 4.$$

Figure 12:
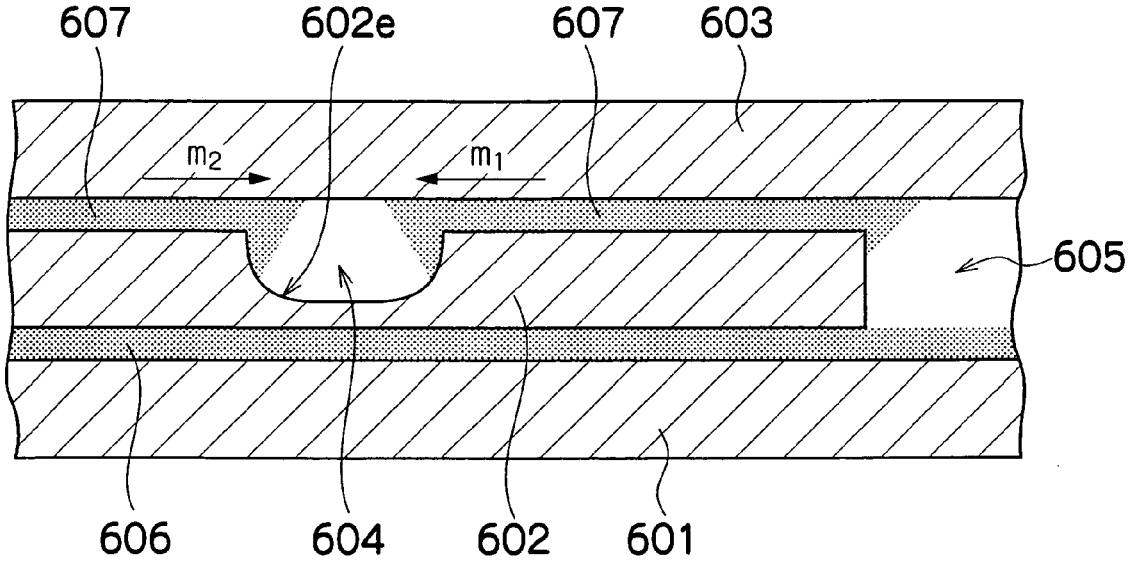
FIG. 12 is a sectional view showing another example of a channel.

Furthermore, as shown in FIG. 12, when a bottomed channel groove 602*e* is provided in the channel plate 602 to form the channel 604, the adhesive 607 between the channel plate 602 and the plate member 603 runs off to the channel 604 from two points. In this case, the total amount of adhesive which runs off is expressed by the following equation (3):

$$\text{Total amount } M = \sum_{n=1}^{2} (t_n - t'_n) \times \frac{L_n}{2}. \quad (3)$$

Thus, when a liquid is flowed to the channel which is formed by laminating the various plate members together, the extent of the sectional area of the channel which is blocked by running off the adhesive determines whether or not to flow the liquid smoothly.

In other words, assuming that no adhesive runs off after hardening the adhesive for joining those plates, when "S'" is an original sectional area of the channel 604 as shown by the broken line in FIG. 10B, it is possible to determine whether or not to flow the liquid smoothly, according to the ratio $$\frac{M}{S'}$$

between the total amount M and the original sectional area S'.

As described above, an experiment is performed for determining whether or not the liquid is flowed smoothly through the formed channels 102 and 112 shown in FIGS. 8A, 8B, 9A, and 9B. When the above equation is calculated by applying the various numerical values to the trial channels 102 and 112, it is possible to obtain the following results.

In the channel 102 having a width of approximately 50 μm, the aforementioned ratio $$\frac{M}{S'}$$

is approximately 0.16, i.e.

$$\frac{M}{S'} = 0.16.$$

In the channel 112 having a channel width of approximately 80 μm, the ratio $$\frac{M}{S'}$$

is approximately 0.07, i.e.

$$\frac{M}{S'} = 0.07.$$

According to the above results, in the case of the channel 102 having a narrow width of approximately 50 μm, a large proportion of the channel is blocked by running off the adhesive, and hence it is possible to determine that an adhesive escape groove is necessary for preventing the channel from being blocked.

Additionally, in a narrow channel having a width and depth of several tens μm, such as the channel in this case, differences in the ratio $$\frac{M}{S'}$$

greatly affect the liquid flow. As described above, the liquid is flowed poorly when the channel width is approximately 50 μm, but is flowed relative smoothly when the channel width is approximately 80 μm. Therefore, according to the ratio $$\frac{M}{S'}$$

between the total amount M of adhesive which runs off to the cross-section of the channel and the channel sectional area S' which is formed in a case in which no adhesive runs off, an adhesive escape groove is provided only around a channel which satisfies following condition:

$$\frac{M}{S'} > 0.07.$$

On the other hand, no adhesive escape grooves are provided around channels which do not satisfy the above condition. Thus, it is possible to reduce the amount of adhesive which runs off during joining of the plate members, while maintaining the high density of the channels.

Figure 13:
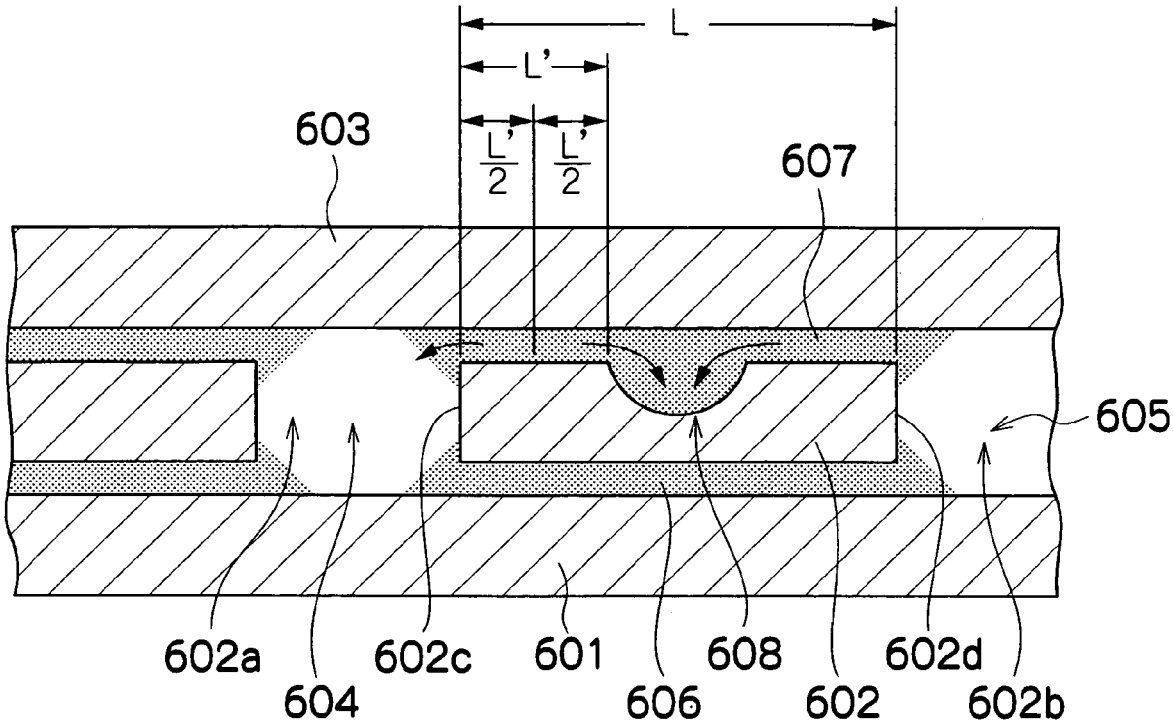
FIG. 13 is a sectional view showing a state in which the adhesive escape groove is formed in relation to the channel.

FIG. 13 shows an example of an adhesive escape groove which is provided around a channel. As described above, when a channel is formed by joining the laminated plate members, an adhesive escape groove is disposed around the channel only when the ratio $$\frac{M}{S'}$$

between the total amount M determined in the equation (1) and the channel sectional area S' is greater than 0.07, i.e. when satisfies following condition:

$$\frac{M}{S'} > 0.07.$$

FIG. 13 shows the channel 604 of FIGS. 10A and 10B, in which an adhesive escape groove 608 is disposed in the channel plate 602 due to the ratio $$\frac{M}{S'}$$

calculated as greater than 0.07.

According to the example shown in FIG. 13, the adhesive escape groove 608 is disposed on the side of the channel plate 602, which faces the plate member 603, upward the part having a length L between the side face 602*c* of the channel hole 602*a* and the side face 602*d* of the other hole 602*b*. The cross-section of the adhesive escape groove 608 has a semi-circular groove form.

Herein, a distance L' (i.e. the shortest distance from the channel 604 to the adhesive escape groove 608) from the side face 602*c* of the channel hole 602*a* to the end of the disposal position of the adhesive escape groove 608 is used to calculate the amount m of adhesive which runs off to the channel 604 in a similar manner to that described above. Specifically, the amount m of adhesive is calculated by $$m = (t - t') \times \frac{L'}{2}.$$

Next, a total amount M' is calculated using the amount m of adhesive. Then, the distance L' is set so that a ratio $$\frac{M'}{S'}$$

between the total amount M' and the channel sectional area S' is no greater than 0.07 when assuming that no adhesive runs off.

More specifically, the (shortest) distance L' from the side face 602*c* of the channel hole 602*a* to the adhesive escape groove 608 is set so that the ratio $$\frac{M'}{S'}$$

between the total amount $$M' = \sum (t - t') \times \frac{L'}{2}$$

which is calculated using the distance L' in a similar manner to that described above and the channel sectional area S', satisfies $$\frac{M'}{S'} = \frac{\sum (t - t') \times \frac{L'}{2}}{S'} \leq 0.07.$$

In the case of assuming that the values of t, t', and L' are identical in each location of the channel 604 that the adhesive runs off, since four points in which the adhesive runs off is provided in the cross-section of the channel 604, then the above inequality becomes $$\frac{\frac{(t - t') \times L'}{2 \times 4}}{S'} \leq 0.07.$$

When transforming this inequality, it is possible to obtain the following inequality:

$$L' < 0.035 \times \frac{S'}{(t - t')}.$$

In such a manner, it is possible to determine an upper limit for the disposal position L' of the adhesive escape groove 608. On the other hand, the lower limit of L'is set to t'<L', according to the thickness t' of the adhesive after hardening as a reference. Therefore, the channel 604 can be sealed satisfactorily so that the channel 604 has an effect of preventing a liquid from leaking.

The adhesive escape groove 608 is provided between the opening portion of the channel 604 that the adhesive runs off when the plates are joined, and the opening portion of the other hole 605. Thus, it is possible to flow into the adhesive escape groove 608 at least half the amount of adhesive that runs off to the opening portions of the channel 604 and other hole 605 at the case in which no adhesive escape grooves 608 are provided. As a result, it is possible to reduce the amount of adhesive running off to the channel 604 correspondingly.

For simply description according to the example in FIG. 13, a single adhesive escape groove 608 is provided in relation to the channel 604. However, adhesive escape grooves according to the present invention may be provided respectively for each of the parts of the channel 604 that the adhesive runs off (for example, if the adhesive runs off to the channel in four points, adhesive escape grooves may be provided for those four points) so that the ratio of $$\frac{M}{S'}$$

described above is no greater than 0.07 for all of the adhesive escape grooves.

In addition, by providing the adhesive escape groove 608, a liquid can be flowed smoothly through the channel 604 when the ratio $$\frac{M}{S'}$$

is no greater than 0.07. Therefore, as long as the ratio $$\frac{M}{S'}$$

described above is no greater than 0.07, it is necessary for providing only the single adhesive escape groove 608 in relation to the single channel 604.

Furthermore, even if only the single adhesive escape groove 608 is provided, it is possible to improve the liquid flow through the channel 604, by modifying the disposal position or size (sectional area) of the adhesive escape groove 608 so that the ratio $$\frac{M}{S'}$$

is no greater than 0.07.

As described above, when providing the adhesive escape groove 608 around the channels 604, the adhesive escape groove 608 does not have to be provided for all of the channels 604. The adhesive escape groove 608 is provided only around the channels 604 having a ratio $$\frac{M}{S'}$$

that is greater than 0.07, and then it is not necessary for providing the adhesive escape groove 608 around any other channels. Therefore, it is possible to reduce the amount of adhesive running off to the channels while maintaining the high density of the channels.

In order to maintain the high density of the channels, it is preferable that as few adhesive escape grooves as possible be disposed. In addition, the adhesive escape grooves actually disposed in consideration of the strength (rigidity) of each plate member, the peripheral form of the attachment position of each plate member, and so on. For example, when the condition $$\frac{M}{S'} > 0.07$$

described above is established for a certain channel, it may be impossible to eliminate this condition (indicating the necessity of disposing an adhesive escape groove) simply by disposing a single adhesive escape groove around the channel. In such a case, adhesive escape grooves are further disposed until the condition is eliminated. Incidentally, the number of adhesive escape grooves to be disposed may be determined by performing a simulation rather than through actual manufacture and measurement.

Figure 14A:
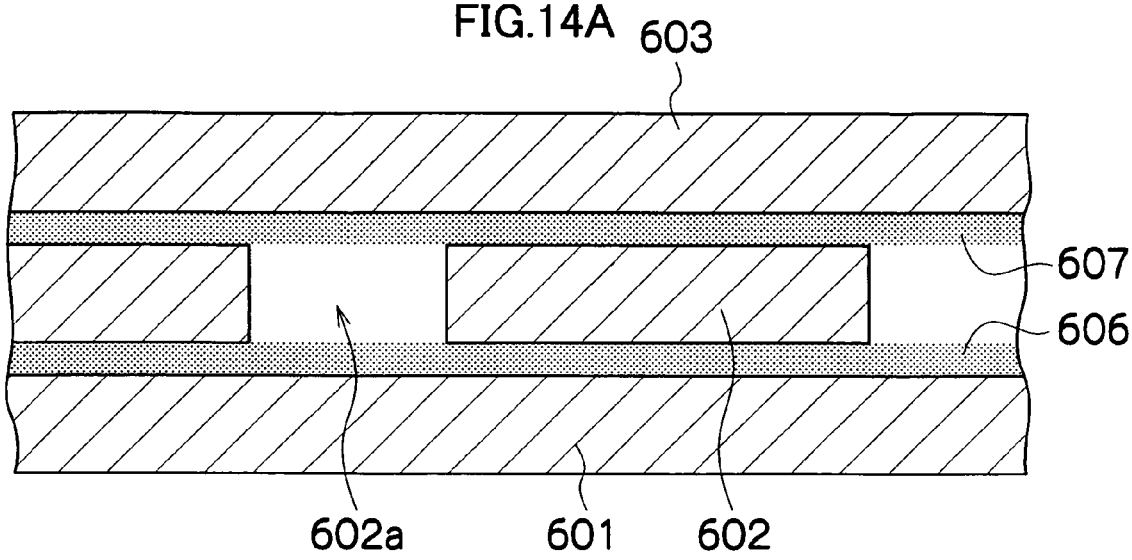
FIGS. 14A to 14C are sectional views of each channel showing each adhesive coating method.
Figure 14B:
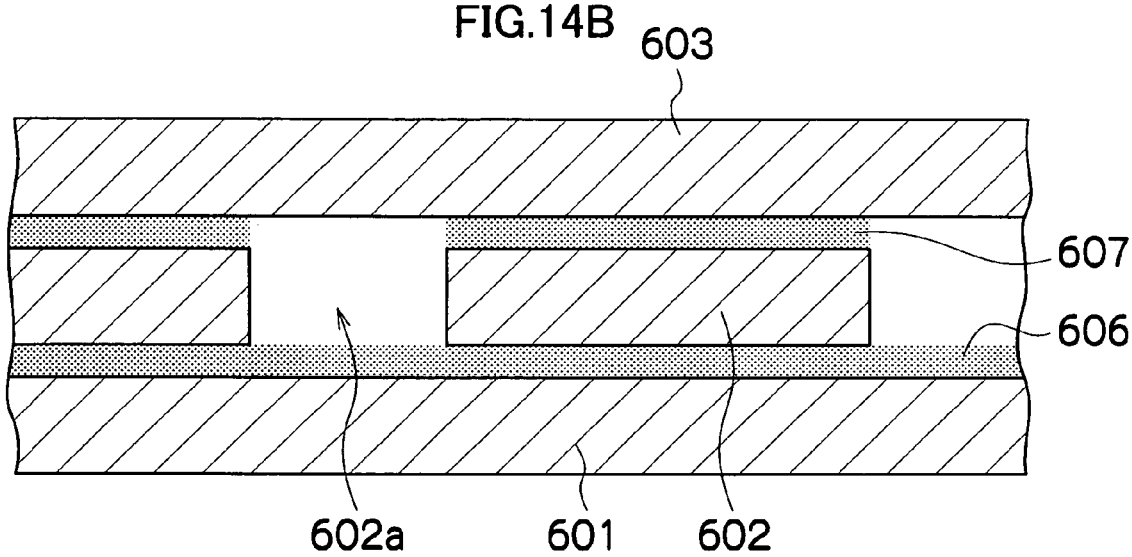
Figure 14C:
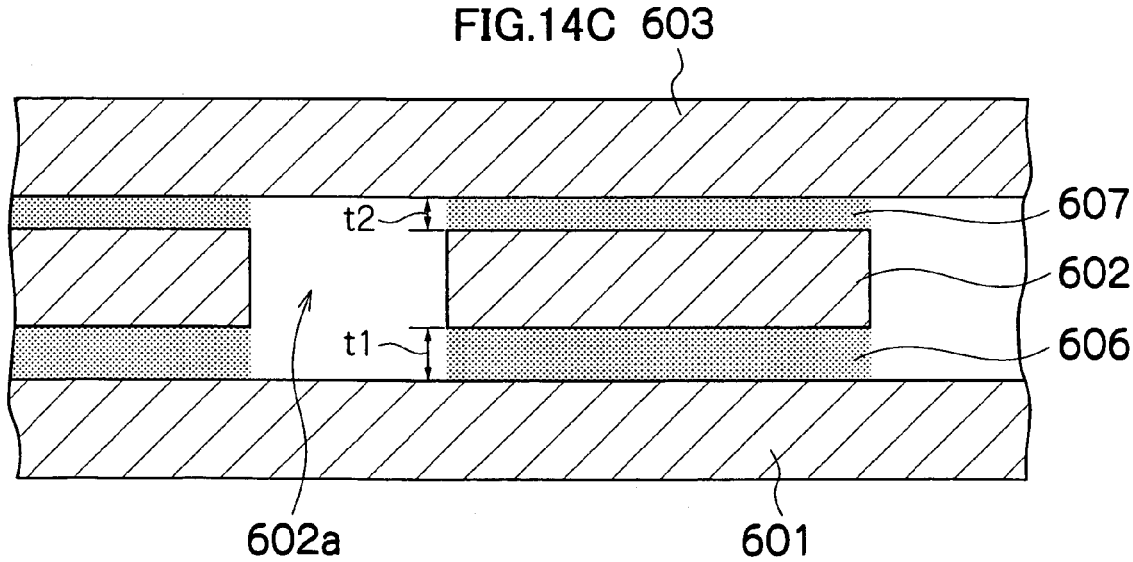

Additionally, there are no particular limitations on the adhesive coating method when laminating together the plate members, and methods shown in FIGS. 14A to 14C may be employed instead of the method shown in FIGS. 10A and 10B.

In the method shown in FIG. 14A, the adhesives 606 and 607 are applied onto the sides of the plate members 601 and 603 facing the channel plate 602 rather than the sides of the channel plate 602 in which the channel hole 602*a* is formed.

In the method shown in FIG. 14B, the adhesive 606 is applied onto the side of the plate member 601 facing the channel plate 602, and the adhesive 607 is applied onto the side of the channel plate 602 facing the plate member 603.

In the method shown in FIG. 14C, the adhesives 606 and 607 are applied onto the sides of the channel plate 602 alone, similarly to FIGS. 10A and 10B. However, the respective thicknesses t1 and t2 of the adhesives 606 and 607 differ between the plate member 601 side and the plate member 603 side.

Regardless of differences in the adhesive coating method, the consideration for providing the adhesive escape grooves is a similar to the method described above. Basically, an adhesive escape groove is disposed in relation to a channel satisfying the equation (1), and it is not necessary for provide adhesive escape grooves with any other channels.

Figure 15B:
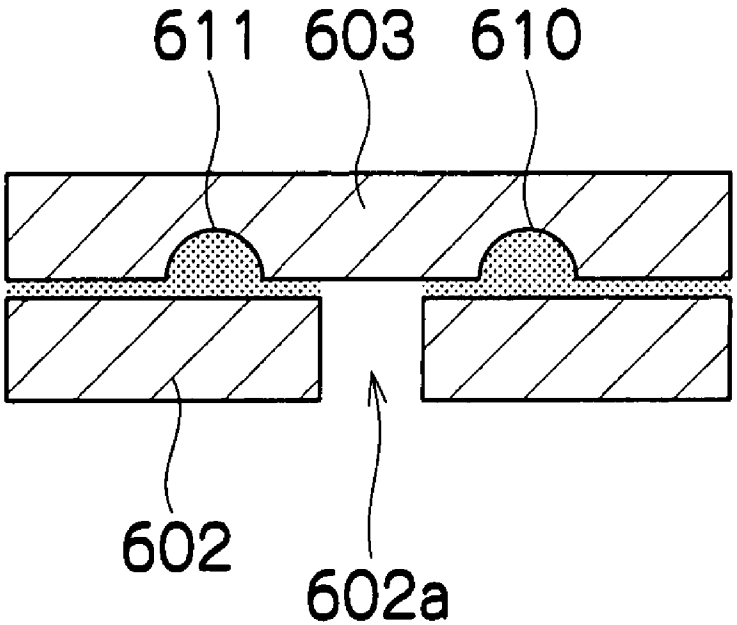
FIGS. 15A and 15B are sectional views showing other examples which dispose each the adhesive escape groove.
Figure 15A:
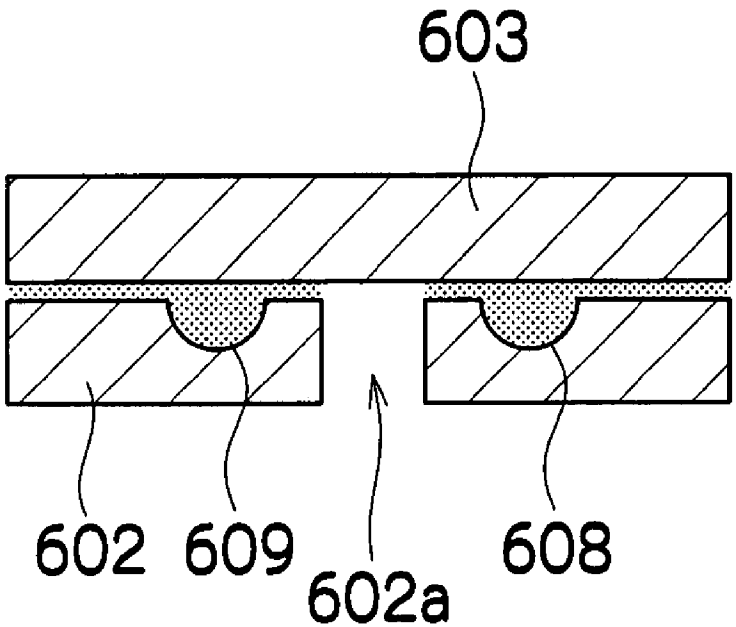

In addition, when an adhesive escape groove is provided, the position of the adhesive escape groove is not limited to the channel plate (602) side as shown in FIG. 13, and it is not necessary for providing only the single adhesive escape groove, as described above. As shown in FIG. 15A, for example, adhesive escape grooves 608 and 609 may be provided on both sides around the channel hole 602*a* in the channel plate 602. Alternatively, as shown in FIG. 15B, adhesive escape grooves 610 and 611 may be provided on the side of the plate member 603 that is adhered to the channel plate 602, in positions corresponding to the periphery of the channel hole 602*a* in the channel plate 602.

However, when adhesive escape grooves are formed in the plate member 603 that is adhered to the channel plate 602, it is necessary for positioning the joining two plates with a high degree of precision. Therefore, it is preferable to form the adhesive escape grooves on the side of the channel plate 602 in which the channel hole is provided, for ease of positioning.

As described above, in the embodiment, the adhesive escape groove is provided according to the ratio $$\frac{M}{S'}$$

between the total amount M of adhesive running off and the channel sectional area S' assuming that no adhesive runs off. Then, the adhesive escape groove is only provided around channels for which the ratio $$\frac{M}{S'}$$

is greater than a predetermined value (0.07). Therefore, it is possible to reduce the amount of adhesive running off to the channel while maintaining a high density of channels.

Furthermore, when actually forming the adhesive escape groove, the disposal position thereof is determined by calculating the total amount M' of adhesive running off with the (shortest) distance L' from the channel to the disposal position of the adhesive escape groove so as to calculate the ratio $$\frac{M}{S'}$$

between the total amount M' and the channel sectional area S' assuming that no adhesive runs off. More specifically, the distance L' is determined as $$\frac{M'}{S'} = \frac{\sum (t - t') \times \frac{L'}{2}}{S'} \leq 0.07.$$

Then, the adhesive escape groove is disposed so that the distance from the channel to the adhesive escape groove satisfies L'. Therefore, it is possible to reduce the amount of adhesive running off.

Additionally, in the embodiment described above, the 1-liquid type thermosetting epoxy adhesive is used as the adhesive. However, the amount of pressure applied thereto during hardening the adhesive may be prescribed according to the relationship between the amount of applied pressure and the amount of compression. Since it is supposed that the amount of compressing the adhesive is related to physical properties such as the surface tension and viscosity of the adhesive, the physical property values of the adhesive may be prescribed so as to determine whether or not to provide an adhesive escape groove, and to determine the disposal position of the adhesive escape groove, according to those physical property values.

Moreover, the present invention can be also applied to the cross-section of the channel having the smallest sectional area.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet discharge head, comprising:

a channel which is formed by joining together a plurality of thin plates which are laminated with an adhesive; and an adhesive escape groove which is provided on at least one joined surface of the thin plates in at least one location on a periphery of the channel when a ratio $$\frac{M}{S'}$$

determined in relation to the channel is greater than a predetermined value, wherein:

the ratio $$\frac{M}{S'}$$

is a ratio between an area M and an area S';

the area M is an area of the adhesive running off to the channel at joining assuming that no adhesive escape groove is provided on the periphery of the channel, the area M being a projected area on a cross-section perpendicular to a flow direction of the channel; and the area S' is an area of a cross-section perpendicular to the flow direction of the channel at post-joining assuming that no adhesive runs off to the channel.

2. The liquid droplet discharge head as defined in claim 1, wherein the predetermined value is 0.07.

3. The liquid droplet discharge head as defined in claim 1, wherein:

when a shortest distance from the channel to the adhesive escape groove is set as L', a pre-joining thickness of the adhesive applied between the thin plates to be joined is set as t, and a post-joining thickness of the adhesive is set as t', a total area $$M' = \sum (t - t') \times \frac{L'}{2}$$

of the adhesive running off to the channel is obtained by adding together an area $$(t - t') \times \frac{L'}{2}$$

of the adhesive running off for all parts of the channel into which the adhesive runs off;

each of the total area M' and the area $$(t - t') \times \frac{L'}{2}$$

is an area which is projected on the cross-section perpendicular to the flow direction of the channel;

a ratio $$\frac{M'}{S'}$$

between the total area M' and the area S' of the cross-section perpendicular to the flow direction of the channel is calculated; and the adhesive escape groove is disposed in a position corresponding to the distance L' at which the calculated ratio $$\frac{M'}{S'}$$

is no greater than the predetermined value.

4. The liquid droplet discharge head as defined in claim 3, wherein the predetermined value is 0.07.

5. An image forming apparatus, comprising the liquid droplet discharge head as defined in claim 1.

6. A manufacturing method of a liquid droplet discharge head which is formed with a channel by joining together a plurality of thin plates which are laminated with an adhesive, the method comprising the steps of:

determining a ratio $$\frac{M}{S'}$$

between an area M and an area S', where the area M is an area of the adhesive running off to the channel at joining assuming that no adhesive escape groove is provided on the periphery of the channel, the area M being a projected area on a cross-section perpendicular to a flow direction of the channel, and the area S' is an area of a cross-section perpendicular to the flow direction of the channel at post-joining assuming that no adhesive runs off to the channel;

providing an adhesive escape groove on at least one joined surface of the thin plates in at least one location on a periphery of the channel when the ratio $$\frac{M}{S'}$$

is greater than a predetermined value; and joining together the thin plates including the adhesive escape groove with the adhesive.

7. The manufacturing method as defined in claim 6, wherein the predetermined value is 0.07.

* * * * *